US005231200A

United States Patent [19]

Kuwabara et al.

[11] Patent Number: 5,231,200

[45] Date of Patent: Jul. 27, 1993

[54] METHOD FOR REFINING AND FRACTIONATION OF PALM OIL AND APPARATUS THEREFOR

[75] Inventors: Yuji Kuwabara, Wakayama; Hiroshi Hidaka, Sakai; Shinichi Imai, Sennan; Ayumi Yabuuchi, Kaizuka; Masaaki Miyabe, Sennan, all of Japan

[73] Assignee: Fuji Oil Company, Limited, Osaka, Japan

[21] Appl. No.: 772,666

[22] Filed: Oct. 7, 1991

[30] Foreign Application Priority Data

Oct. 19, 1990 [JP] Japan ..... 2-282602

[51] Int. Cl.[5] ..... C11B 3/10; C11B 3/12

[52] U.S. Cl. ..... 554/191; 554/202

[58] Field of Search ..... 260/420; 554/191, 202

[56] References Cited

PUBLICATIONS

Chemical Abstracts, vol. 87, #15, p. 800, 1977 116580q.

*Primary Examiner*—José G. Dees
*Assistant Examiner*—Deborah D. Carr
*Attorney, Agent, or Firm*—Wenderoth, Lind & Ponack

[57] ABSTRACT

A method for refining and fractionation of palm oil is disclosed. In this method, palm oil or palm fractionated oil which has been treated by physical refining is treated with an adsorbent, followed by subjecting it to dry fractionation. An apparatus for refining and fractionation of palm oil comprising means for treating palm oil or palm fractionated oil with an adsorbent and dry fractionation means connected thereto is also disclosed.

3 Claims, No Drawings

METHOD FOR REFINING AND FRACTIONATION OF PALM OIL AND APPARATUS THEREFOR

FIELD OF THE INVENTION

The present invention relates to a method for refining and fractionation of palm oil or palm fractionated oil and an apparatus therefor.

BACKGROUND OF THE INVENTION

Palm oil is fractionated in one- or two-staged by solvent fractionation, detergent fractionation, dry fractionation and the like. Generally, in the case of two-stage fractionation, an olein fraction (lower melting point fraction) obtained by the first stage fractionation is separated into a fraction called as super olein and a middle melting point fraction (PMF).

Among the above mentioned fractionation methods of palm oil, a method which is most generally employed today is dry fractionation wherein treatment can be carried out inexpensively. However, the fractionation method has such a defect that the precision of fractionation is lower in comparison with other fractionation methods because a liquid portion which is taken into crystals during crystal growing process is larger. For example, the yield of olein obtained by one-stage fractionation of palm oil is not less than 70% in the case of solvent fractionation or detergent fractionation method, while the yield is often lower than 65% in the case of dry fractionation method [J.A.O.C.S., 62 (2) 210–219 (1985)].

This tendency is increased as the amount of a crystal part formed becomes larger and, therefore, in the above-mentioned general two-stage fractionation, the precision of fractionation becomes more important in the second stage than that in the first stage. In particular, it is desired to obtain PMF having a lower iodine value (hereinafter abbreviated as I.V.) in view of production of PMF to be used for hard butter. However, in order to reduce the I.V. to lower than 50, there is required other means for increasing the precision of fractionation, for example, means for increasing compression pressure applied to solid-liquid separation or the like.

In addition, since various impurities are contained in crude palm oil, which causes blinding when loaded on a crystallizing apparatus or a filter and varies the quality of the desired product, generally, refining steps such as degumming, decolorization and physical deacidification (RBD: Refined Bleached Deodorized), or neutralization, decolorization and physical deacidification or deodorization (NBD: Neutralized Bleached Deodorized) are carried out before dry fractionation. And, in an apparatus used therefor, dry fractionation means is connected to physical refining means.

OBJECTS OF THE INVENTION

One object of the present invention is to provide a method for refining and fractionation of palm oil or palm olein which can improve the efficiency of fractionation in dry fractionation of palm oil or palm olein.

Another object of the present invention is to provide an apparatus to be used for the method of the present invention.

Particularly, the present invention aims to facilitate the production of PMF in excellent quality as hard butter.

These objects as well as other objects and advantages of the present invention will become apparent to those skilled in the art from the following description.

SUMMARY OF THE INVENTION

In order to attain the above objects, the present inventors have intensively studied and have presumed that there must be a certain factor which inhibits the growth of good crystals having a lower liquid part which is taken into the crystals during crystal formation, and good crystals would be formed by removing such a factor. Then, the present inventors have further intensively studied various refining steps. As a result, it has been found that good crystals, i.e., large crystals which are readily separated in solid-liquid separation can be obtained by carrying out treatment with an adsorbent such as activated carbon or the like, which has no effect on crystal formation if employed in decolorization step, at a particular step, i.e., after physical refining and before dry fractionation.

According to the present invention, there is provided a method for refining and fractionation of palm oil which comprises treating palm oil or palm fractionated oil which has been treated by physical refining with an adsorbent and then subjecting it to dry fractionation. Also provided is an apparatus for refining and fractionation of palm oil comprising means for treating palm oil or palm fractionated oil with an adsorbent and dry fractionation means connected thereto.

DETAILED DESCRIPTION OF THE INVENTION

In the present invention, the physical refining is a distillation treatment with heating called physical deacidification or deodorization and is normally carried out by placing an oil under reduced pressure at a temperature of 200° C. or higher. As conventional methods, this refining is necessary for carrying out dry fractionation effectively, and it is preferred to pass through refining steps such as degumming, decolorization and the like as the pretreatment steps.

Fractionation of palm oil or palm fractionated oil which has been treated by such the physical refining per se can be carried out by known methods, and palm fractionated oil may be any melting point fraction and most generally an olein fraction. In addition, RBD or NBD palm oils, or commercially available their olein thereof can also be used.

Palm oil or palm fractionated oil which has been treated by the physical refining is then treated with an adsorbent.

As the adsorbent, activated carbon, activated clay, silica gel or the like can be used. A most preferred adsorbent is activated carbon and activated clay having higher acidity (an amount necessary for neutralization-titrating by an alkali is not less than 3 mg KOH/g, preferably not less than 8 mg KOH/g) is also preferred. Other adsorbents have relatively lower effect.

The treatment with the adsorbent is carried out by contacting the oil with the adsorbent at a temperature ranging from that higher than the point wherein crystals of palm oil or palm fractionated oil hardly deposit to not higher than 140° C., preferably not higher than 120° C. Although the treating time somewhat varies depending upon a stirring apparatus, stirring efficiency and the like, the time from 10 minutes to 1 hour is usually sufficient. However, when the treatment is carried out with heating at about 80° C. or higher, it is preferred that the treatment is carried out under conditions that the oil is not exposed to air, for example, under reduced pressure or in an inert gas in order to prevent the oil from deterioration. The amount of the adsorbent to be used is from 0.01 to 3% by weight, preferably from 0.05 to 1% by weight based on the oil, when the adsorbent is added to palm oil or palm fractionated oil. Alternatively, the oil can pass through a column packed with the adsorbent and in this case, the prescription of the amount is not of importance.

Then, the oil thus treated is subjected to dry fractionation. In the present invention, any step wherein a temperature is raised to above 140° C., for example, a physical refining step can not be employed between the above-mentioned treatment with the adsorbent and dry fractionation. If the temperature of the oil exceeds 140° C. between these steps, the precision of fractionation is lowered.

Dry fractionation is a fractionation method wherein any solvent or detergent is not used and, as is well known, the method comprises forming crystal nuclei by cooling a fat or oil in a melted state, aging them at a low temperature to grow crystals and then subjecting them to solid-liquid separation. Typical examples of such a method include Tirtiaux method, Desmet method and the like. And a recently developed method such as that described in JP-A 2-14290 wherein crystallization is carried out in a stationary state and solid-liquid separation is carried out after cracking and fluidization can also be suitably employed. Dry fractionation in the present invention is not limited to any specific method. For solid-liquid separation, there are filtration and centrifugation but, usually, a belting press and filter press are employed.

Another aspect of the present invention is an apparatus for refining and fractionation of palm oil wherein means for treatment with an adsorbent is connected to dry fractionation means. Physical refining means may be connected before the means for treatment with an adsorbent.

Examples of the means for treatment with an adsorbent include a mixing apparatus equipped with stirring means, an in-line mixer, a column packed with an adsorbent and the like. Examples of the dry fractionating means include known means such as Tirtiaux apparatus, Desmet apparatus and the like.

As described hereinabove, according to the present invention, the efficiency of dry fractionation of palm oil or palm olein can be improved, and PMF in excellent quality as hard butter can be readily obtained.

The following Examples further illustrate the present invention in detail but are not to be construed to limit the scope thereof.

EXAMPLE 1

RBD palm oil (I.V.: 52.0), i.e., refined palm oil obtained by degumming, decolorizing and physically deacidifying the crude palm oil was, as it was or after addition of activated carbon in an amount 0.5% by weight based on the oil, stirred at 100° C. for 30 minutes under vacuum (120 torr), and was filtered under vacuum. This was supplied into Tirtiaux fractionation plant (wherein crystallization by a vertical type chiller equipped with a stirrer and compression using a filter press were carried out), cooled therein to form crystals, and dry fractionation was carried out by aging at a final product temperature of 26° C. or 22° C. for 30 hours to obtain the fractionated oil as shown in Table 1.

As is apparent from the results in Table 1, when No. 1 is compared with No. 2, I.V.'s of their liquid fractions are almost equal to each other, but the yield of No. 2 is lower. Further, both I.V. and yield of the solid fractions are different from each other and No. 2 has both higher I.V. and yield. These show that the lower I.V. of the solid fraction and the higher yield of the liquid fraction are resulted from sufficient separation of the liquid ingredient from compressed cake due to the treatment with activated carbon in comparison with No. 2 wherein such a treatment is not carried out. Thus, it is shown that the precision of fractionation is increased. Similar results are also obtained by comparing No. 3 with No. 4.

TABLE 1

| | | No. 1 | No. 2 | No. 3 | No. 4 |
|---|---|---|---|---|---|
| Treatment with activated carbon | | yes | no | yes | no |
| Fractionation conditions | | | | | |
| Crystallizing temp. (°C.) | | 26 | 26 | 22 | 22 |
| Crystallizing time (hour) | | 30 | 30 | 30 | 30 |
| Pressure (kg/cm$^2$) | | 6 | 6 | 6 | 6 |
| Compression time (min.) | | 30 | 30 | 30 | 30 |
| Fractionated oil | | | | | |
| Liquid | I.V. | 56.3 | 56.2 | 57.0 | 57.1 |
| | Yield (%) | 80.5 | 76.9 | 76.7 | 69.8 |
| Solid | I.V. | 34.2 | 38.0 | 35.6 | 40.2 |
| | Yield (%) | 19.5 | 23.1 | 23.3 | 30.2 |

EXAMPLE 2

After an activated carbon was added to RBD palm olein oil No. 2 obtained in Example 1 in an amount of 0.2% by weight based on the oil or without addition thereof, the oil was stirred at 100° C. for 30 minutes under 120 torr of vacuum, filtered under vacuum and the filtrate was cyrstallized with a vertical chiller equipped with a stirrer and compressed using a filter press to obtain the fractionated oil shown in Table 2.

In any comparison between No. 1 and No. 2, No. 3 and No. 4, and No. 5 and No. 6, it is shown that the precision of fractionation is increased by treatment with activated carbon. In No. 1 and No. 3 according to the present invention, there is an improvement of the precision of fractionation which can be comparable to or higher than that of No. 6 wherein solid-liquid separation is carried out at higher pressure.

TABLE 2

| | | Fractionation conditions | | | | Fractionated product | | | |
|---|---|---|---|---|---|---|---|---|---|
| | | | | | | Liquid | | Solid | |
| No. | Activated carbon treatment | Crystn. temp. (°C.) | Crystn. time (hour) | Pressure (kg/cm$^2$) | Compression time (min.) | I.V. | Yield (%) | I.V. | Yield (%) |
| 1 | yes | 15 | 25 | 6 | 30 | 62.0 | 59.5 | 47.2 | 40.5 |
| 2 | no | 15 | 25 | 6 | 30 | 61.6 | 47.2 | 51.0 | 52.8 |
| 3 | yes | 18 | 35 | 6 | 30 | 60.4 | 70.1 | 45.7 | 29.9 |
| 4 | no | 18 | 35 | 6 | 30 | 60.1 | 63.1 | 49.0 | 36.9 |
| 5 | yes | 15 | 25 | 30 | 30 | 62.2 | 67.4 | 43.2 | 32.6 |

TABLE 2-continued

| No. | Activated carbon treatment | Fractionation conditions: Crystn. temp. (°C.) | Crystn. time (hour) | Pressure (kg/cm²) | Compression time (min.) | Fractionated product: Liquid I.V. | Liquid Yield (%) | Solid I.V. | Solid Yield (%) |
|---|---|---|---|---|---|---|---|---|---|
| 6 | no | 15 | 25 | 30 | 30 | 61.9 | 59.9 | 47.2 | 40.1 |

Additionally, when the oil of No. 1 after treated with the activated carbon was steam-distilled at 150° C. for 90 minutes under 3 torr of vacuum and this was dry-fractionated as in No. 3, the results showed that I.V. and yield of the solid fraction were 50.5 and 51.3%, respectively. Thus, the precision of fractionation was lowered.

EXAMPLE 3

After activated carbon, activated clay having 10.7 mg KOH/g of acidity in neutralizing titration amount or silica was added to RBD palm oil (I.V.: 52.0) in an amount of 0.5% by weight based on the oil or without addition thereof, the oil was stirred for 30 minutes under 120 torr of vacuum, filtered under vacuum and this was fractionated by crystallization using a vertical chiller equipped with a stirrer and compression using a filter press to obtain the fractionated oil shown in Table 3.

As shown in Table 3, the order of superiority of the fractionation efficiency is treatment with activated carbon, treatment with activated clay, treatment with silica and non-treatment.

TABLE 3

| | | No. 1 Activated carbon | No. 2 Activated clay | No. 3 Silica | No. 4 Non-treatment |
|---|---|---|---|---|---|
| | | Treatment | | | |
| Fractionation conditions | | | | | |
| Crystn. temp. (°C.) | | 25 | 25 | 25 | 25 |
| Crystn. time (hour) | | 30 | 30 | 30 | 30 |
| Pressure (kg/cm²) | | 6 | 6 | 6 | 6 |
| Compression time (min.) | | 30 | 30 | 30 | 30 |
| Fractionated oil | | | | | |
| Liquid | I.V. | 56.4 | 56.7 | 56.5 | 56.5 |
| | Yield (%) | 79.8 | 78.2 | 75.7 | 74.3 |
| Solid | I.V. | 34.6 | 35.1 | 38.0 | 39.0 |
| | Yield (%) | 20.2 | 21.8 | 24.3 | 25.7 |

What is claimed is:

1. A method for refining and fractionation of palm oil which comprises treating palm oil or palm fractionated oil, which has been treated by physical refining comprising distallation at reduced pressure and at a temperature of at least 200° C., with an adsorbant and then subjecting it to dry fractionation.

2. A method according to claim 1, wherein the adsorbent is activated carbon.

3. The method according to claim 1, wherein the treatment with the adsorbent is carried out at a temperature of not higher than 140° C.

* * * * *